US005256029A

United States Patent [19]

Fluck

[11] Patent Number: 5,256,029

[45] Date of Patent: Oct. 26, 1993

[54] METHOD AND APPARATUS FOR FORMING ARTICLE GROUPS

[75] Inventor: René Fluck, Schleitheim, Switzerland

[73] Assignee: Sig Schweizerische Industrie-Gesellschaft, Neuhausen am Rheinfall, Switzerland

[21] Appl. No.: 920,338

[22] Filed: Jul. 29, 1992

Related U.S. Application Data

[63] Continuation-in-part of Ser. No. 688,249, Apr. 22, 1991, Pat. No. 5,186,599.

[30] Foreign Application Priority Data

Jul. 29, 1991 [CH] Switzerland ..... 2255/91-2

[51] Int. Cl.[5] ..... B05B 5/08

[52] U.S. Cl. ..... 414/792.9; 414/786; 53/532

[58] Field of Search ..... 53/254, 532, 251, 538, 53/540; 414/792.9, 793, 793.1, 788.4, 788.7, 789.6, 792.5, 792.6, 792.7, 792.8, 730, 736, 737, 752; 198/413.8

[56] References Cited

U.S. PATENT DOCUMENTS 3,434,603 3/1969 Horman .
4,955,794 9/1990 Fluck ..... 414/790.4

FOREIGN PATENT DOCUMENTS 521265 5/1972 Switzerland .
1328331 8/1973 United Kingdom .
2218679 11/1989 United Kingdom .

*Primary Examiner*—Michael S. Huppert
*Assistant Examiner*—Gregory A. Morse
*Attorney, Agent, or Firm*—Spencer, Frank & Schneider

[57] ABSTRACT

An apparatus for forming article groups from flat articles includes a belt conveyor for advancing thereon an article column formed of individual, flat-lying articles; a sensor supported above the conveyor surface for sensing the presence of articles on the conveyor surface; a series of article grippers situated downstream of the sensor as viewed in the direction of advance; a mechanism for shifting the grippers from above the conveyor surface to a position laterally of the conveyor surface; a group-forming device including a plurality of containers and a mechanism for positioning the containers at a location in which the articles are released by the grippers and are deposited into the containers to form stacks of superposed articles therein. The mechanism moves the containers stepwise downwardly during the stacking operation. There is further provided a control apparatus having an input connected to the sensor for receiving signals therefrom. The control apparatus has outputs connected to the shifting and positioning mechanisms.

10 Claims, 6 Drawing Sheets

METHOD AND APPARATUS FOR FORMING ARTICLE GROUPS

CROSS REFERENCE TO RELATED APPLICATION

This application is a continuation-in-part of application Ser. No. 07/688,249, filed Apr. 22, 1991, and now Pat. No. 5,186,599.

This application claims the priority of Swiss Application No. 2255/91-2 filed Jul. 29, 1991, which is incorporated herein by reference.

BACKGROUND OF THE INVENTION

This invention relates to a method and an apparatus for forming groups (stacks) of flat articles advanced on a conveyor belt to group-forming chambers. The articles lie flat and individually on the conveyor belt and form columns thereon.

An apparatus of the above-outlined type is disclosed in Swiss Patent No. 521,265. The apparatus disclosed in this patent first forms article columns on a conveyor belt from a "carpet" of adjacent articles, and thereafter the articles are accumulated by means of circulating receiving fingers which convey the articles through a stage where pairs of articles in a superposed state are formed and are pushed by means of a pusher into group-forming chambers where article stacks are built. While such a prior art apparatus has been found to be generally satisfactory in practice, it has the disadvantage that the forming of a column as well as a guidance and accumulation of articles are required. These steps impose a limit on the capacity of the apparatus and further, the articles must be relatively robust. Thus, such an apparatus is not too well adapted for handling delicate articles such as flat confectionery items.

SUMMARY OF THE INVENTION

It is an object of the invention to provide an improved method and apparatus of the above-outlined type with which a high output is achieved while a gentle handling of the articles is ensured.

This object and others to become apparent as the specification progresses, are accomplished by the invention, according to which, briefly stated, the apparatus for forming article groups from flat articles includes a belt conveyor for advancing thereon an article column formed of individual, flat-lying articles; a sensor supported above the conveyor surface for sensing the presence of articles on the conveyor surface; a series of article grippers situated downstream of the sensor as viewed in the direction of advance; a mechanism for shifting the grippers from above the conveyor surface to a position laterally of the conveyor surface; a group-forming device including a plurality of containers and a mechanism for positioning the containers at a location in which the articles are released by the grippers and are deposited into the containers to form stacks of superposed articles therein. The mechanism moves the containers stepwise downwardly during the stacking operation. There is further provided a control apparatus having an input connected to the sensor for receiving signals therefrom. The control apparatus has outputs connected to the shifting and positioning mechanisms.

According to a further feature of the invention, each gripper has its own lifting motor and is provided with a guide at a pivot shaft to guide each gripper during the lifting and lowering motion transversely to the pivot shaft.

According to a further feature of the invention, the conveyor belt may be provided with a decoding device which is connected to a control apparatus.

In accordance with a further feature of the invention, the lifting motions of the grippers, the motion of the conveyor belt, the oscillating motion of the pivot shaft and the motion of the group-forming chambers may be coordinated by the control apparatus.

It is a advantage of the apparatus according to the invention that the conveying paths may be very short even in case of articles which are of irregular shape and which can be stacked only with difficulty. The short conveying paths result in a high output without exposing the articles to appreciable stresses.

It is a further advantage of the invention that the containers which are oriented at an inclination to the vertical are lowered in small steps which ensures a reliable stacking of articles.

According to another advantage of the invention, the articles may be further conveyed without difficulty, particularly into standby grouping devices, manual packing stations, accumulators and further, unlike products and groupings may be handled by a simple adjustment of the process program.

It is still another advantage of the apparatus according to the invention that its spatial requirements are very small and it provides a superior overview for the operating personnel.

DESCRIPTION OF THE PREFERRED EMBODIMENTS

Figure 1:
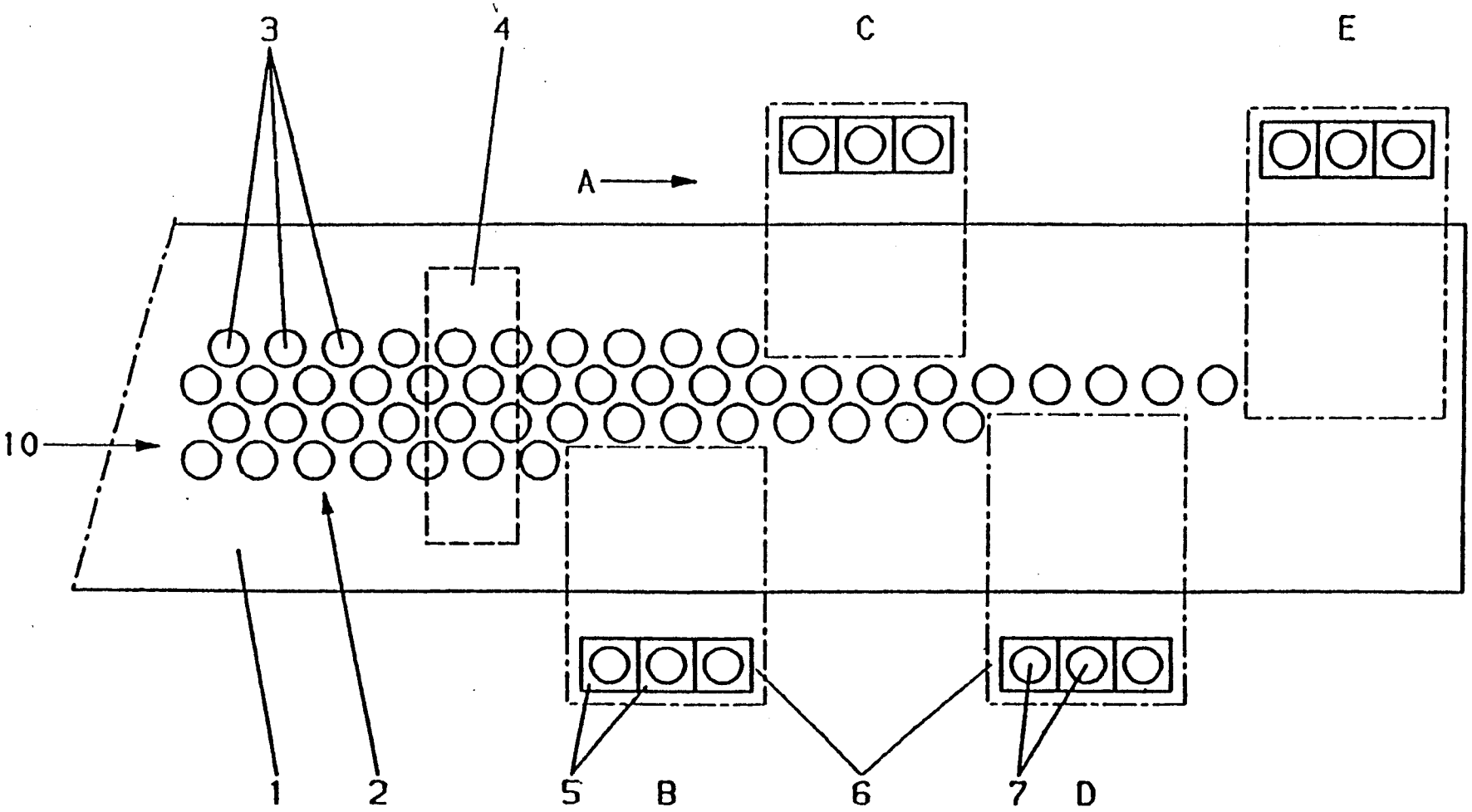
FIG. 1 is a schematic top plan view of one part of the article-grouping apparatus incorporating the invention.

Turning to FIG. 1, on a conveyor belt 1 individual, flat-lying confectionery items 3 are advanced in a conveying direction A as an item carpet 2 in a slightly spaced, side-by-side and serially arranged orientation as they emerge from a non-illustrated baking oven. A sensor station 4 provided with a plurality of reflecting light barriers determines the position of the items on the conveyor belt 1. Downstream of the sensor station 4—as viewed in the conveying direction—on either side of the conveyor belt i a plurality of consecutive stations B, C, D and E are arranged which are provided with gripping devices (to be described later in detail in conjunction with FIGS. 3, 4 and 5) for successively removing items 3 from the belt 1 and for stacking the flat-lying items on one another in group-forming chambers 5. The group-forming chambers 5 are schematically shown in FIG. 1 as packaging containers, each accommodating three stacks 7 of items 3. The item quantity decrease on the conveyor 1 in the conveying direction A thus equals the item quantity increase in the item group-forming chambers 5. Therefore, there can be provided a plurality of lowering devices which will be described in detail in conjunction with FIG. 6, and whose number corresponds to the number of stations B, C, D, E. Preferably, there are several, e.g. three grippers for each container and each gripper may feed a separate container or all the grippers of one station may feed a single container which accommodates several item stacks 7 side-by-side.

Figure 2:
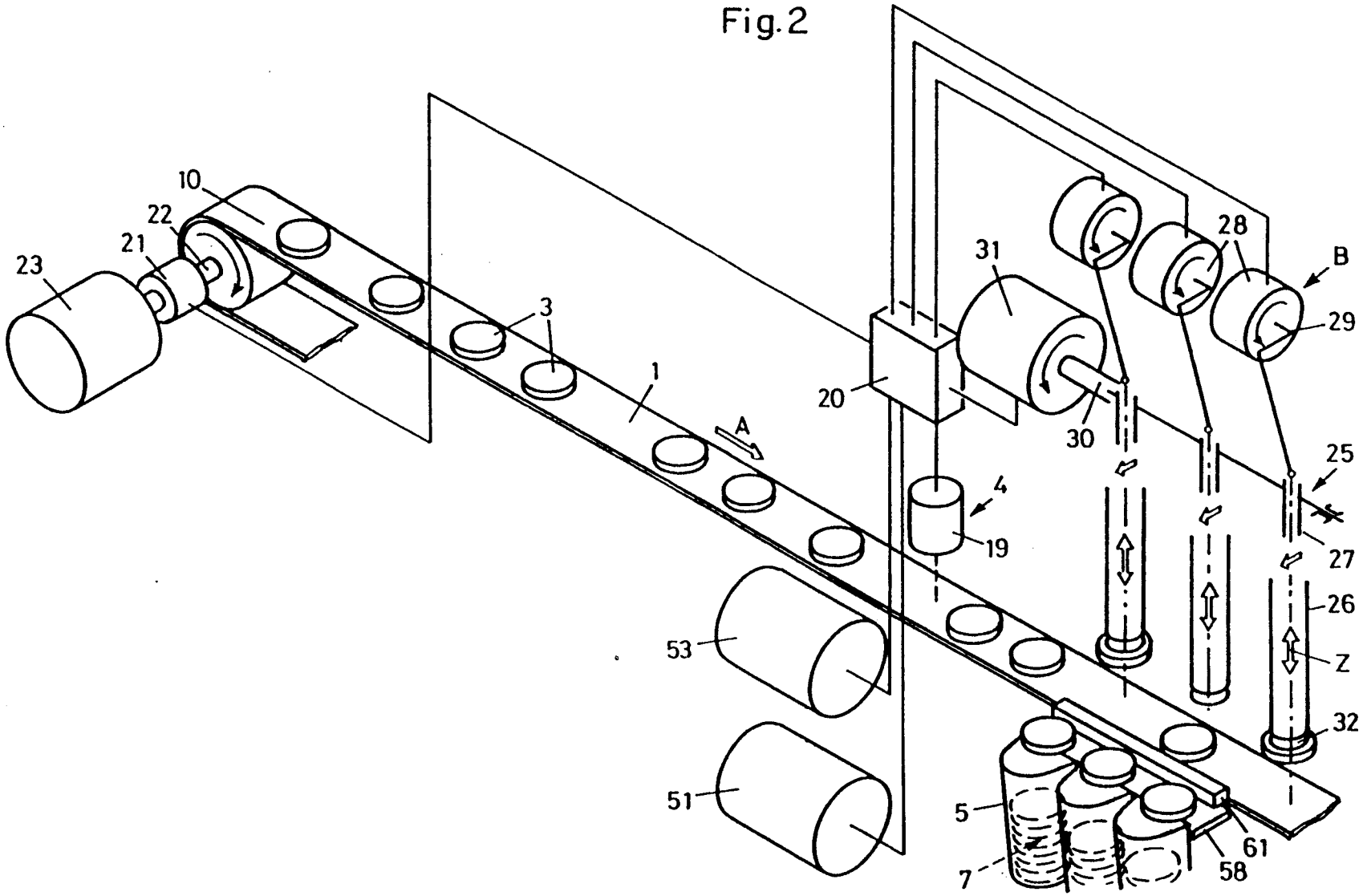
FIG. 2 is a schematic perspective view of one part of the article-grouping apparatus according to the invention.

In FIG. 2, the conveyor belt 1 is, for simplicity of illustration, shown to have a width accommodating but a single column 10 of articles 3. A sensor 19 (optical barrier) of the sensor station 4 scans the items 3 of the outermost column 10 and reports the position of the items on the conveyor belt 1 to a control apparatus 20. The sensor 19 may be so arranged that it senses both the length and the width position of the articles 3. The control apparatus 20 also obtains signals from an angular position indicator 21 which is coupled to the shaft 22 of a drive motor 23 circulating the conveyor belt 1. The gripping unit 25 in the station B includes three grippers 26 arranged in series parallel to the conveying direction A.

Figure 3:
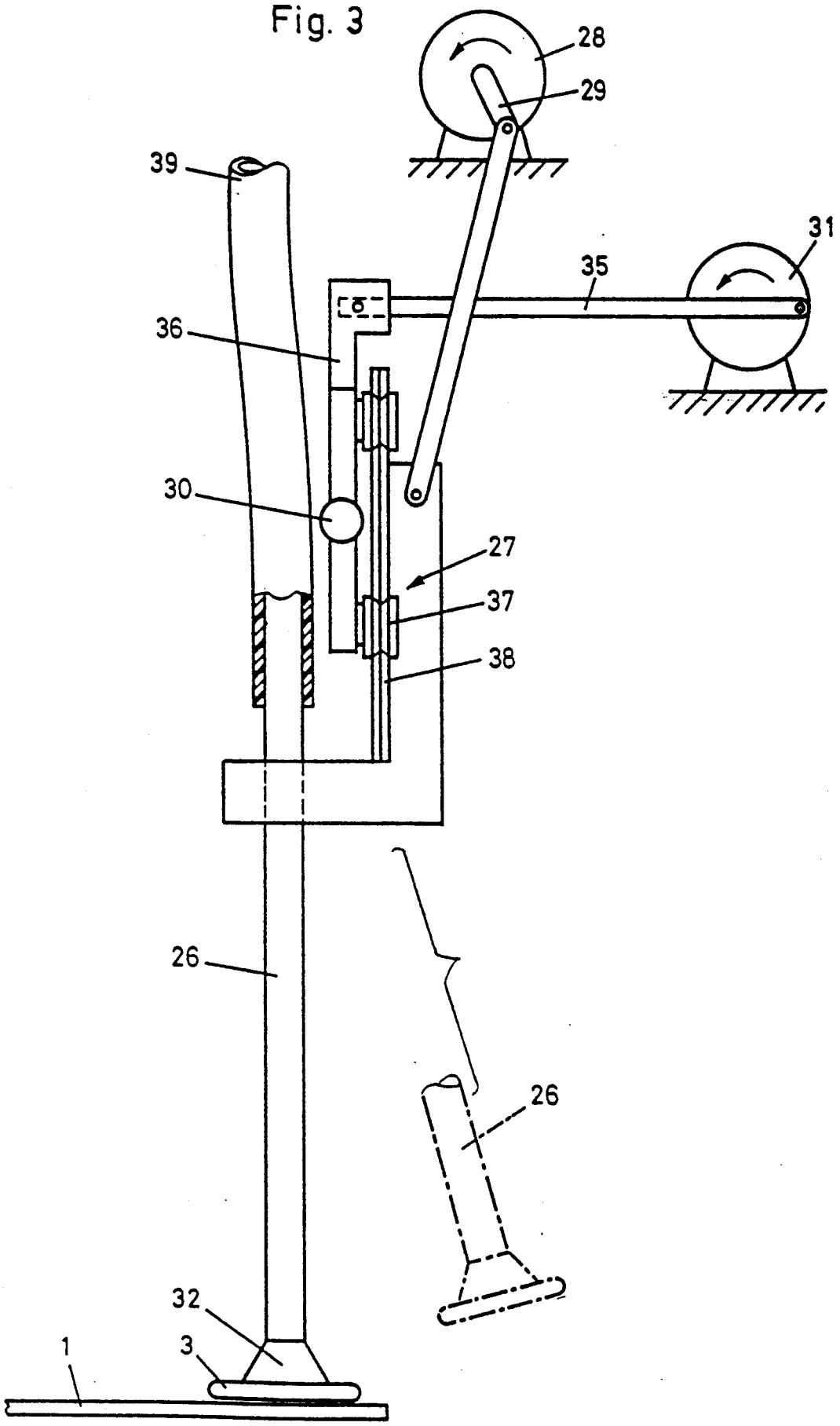
FIG. 3 is a schematic front elevational view, partially in section, of a part of the gripper mechanism forming part of the article-grouping apparatus.
Figure 4:
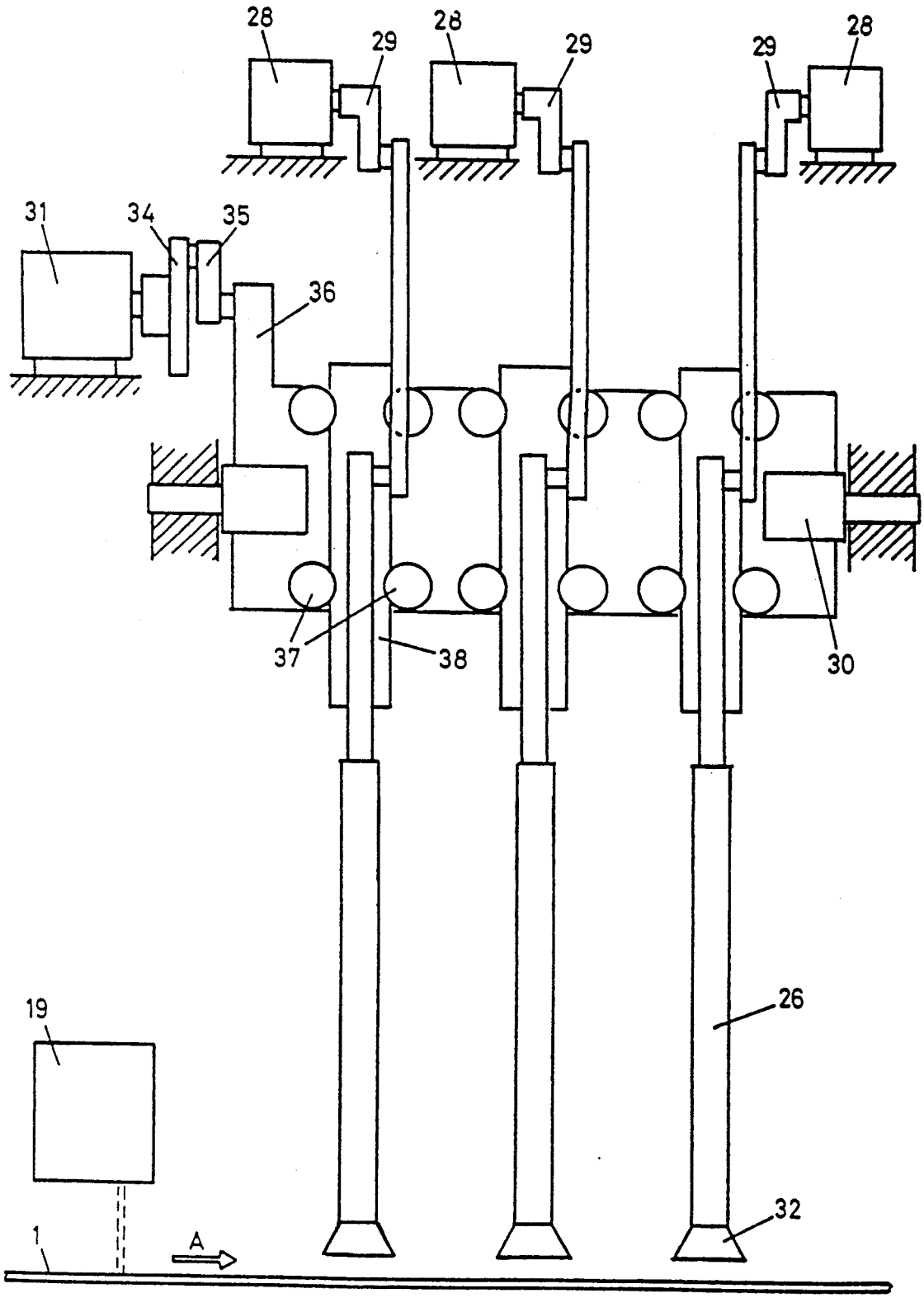
FIG. 4 is a schematic side elevational view of the structure shown in FIG. 3.

Turning to FIGS. 3 and 4, the gripping unit 25 schematically shown in FIG. 2 is illustrated in more detail. The gripper 26 is suspended from a guide 27 which, in turn, is pivotally supported by a horizontal shaft 30. The motor 31, during a 180°-turn, rotates the shaft 30 by means of a crank 34, a push rod 35 and a lever 36 to move all the grippers of the unit 26 into the dash-dotted lateral position shown in FIG. 3. The guide 27 is formed of two pairs of circumferentially grooved rollers 37 engaging respective rails 38 of wedge-shaped cross section. Individual motors 28 with cranks 29 vertically reciprocate each gripper 26 in the respective guide 27. The tubular gripper 26 is connected by a hose 39 to a vacuum source, not shown.

Figure 5:
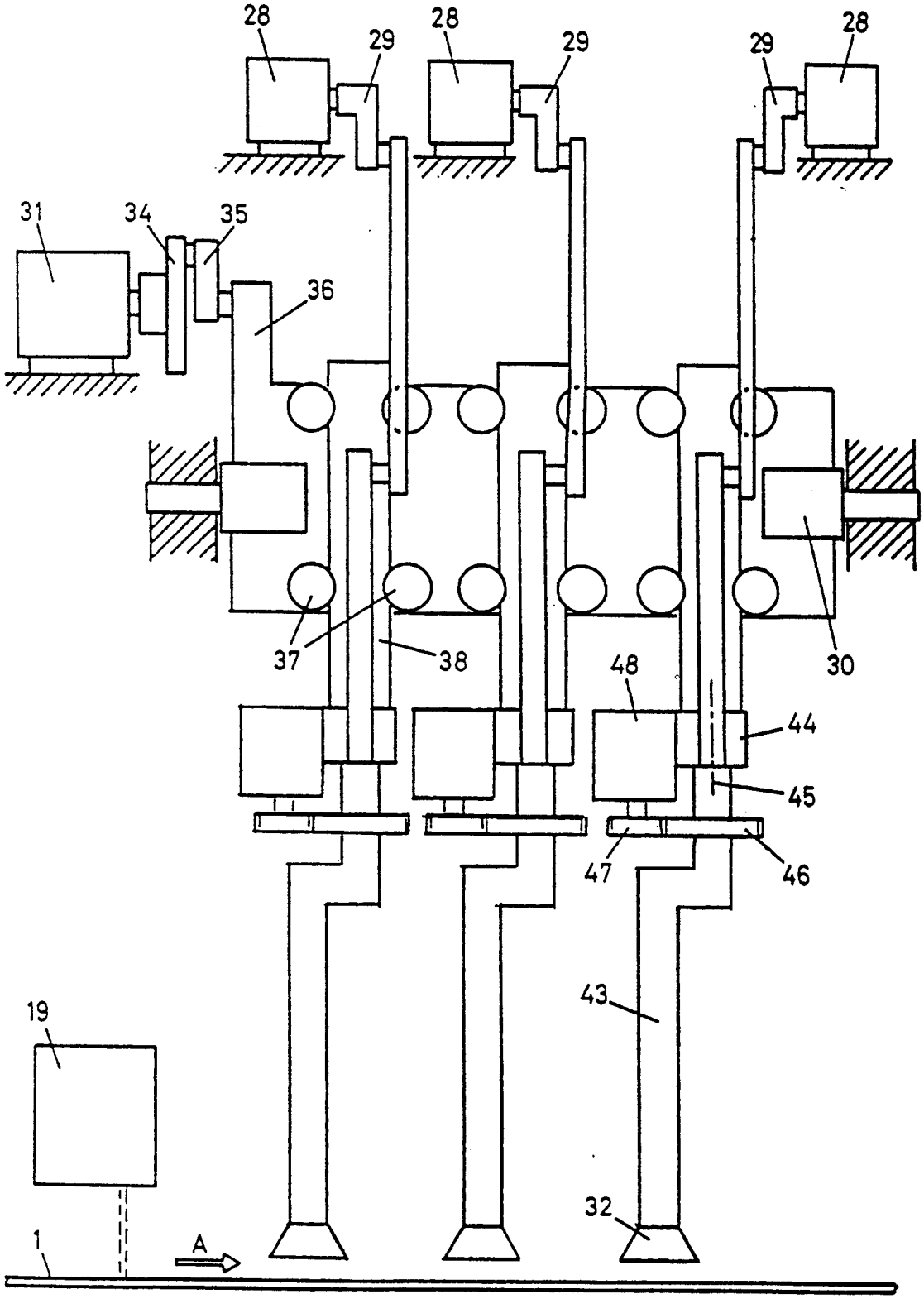
FIG. 5 is a schematic side elevational view of a variant of the FIG. 4 structure.

The embodiment shown FIG. 5 differs from that of FIG. 4 in that the suction heads 32 of the grippers 26 are shiftable individually transversely to the conveying direction A. For this purpose the tubes 43 of the grippers 26 are angled twice underneath a rotary bearing 44 so that the suction heads 32 are disposed eccentrically to the rotary axis 45. To each gripper tube 43, underneath the bearing 44, a gear 46 is secured which meshes with a pinion 47 which, in turn, is driven by a further motor 48. By virtue of this arrangement, each suction head 32, driven by the respective motor 48, may be shifted transversely to the conveying direction A. This is particularly useful if the item carpet 2 does not form item columns 10. In such a case, for controlling the motors 48, the sensor station 4 has to transmit signals representing the position of the items transversely to the conveying direction A. This is feasible, for example, by using a significantly greater number of optical barriers 19 or a TV camera associated with an appropriate evaluating device.

The motors 23, 28 and 31 as well as the motors 51 and 53 of the lowering device (to be described below in conjunction with FIG. 6 and not illustrated in FIGS. 1–5) are coupled to the control apparatus 20.

Figure 6:
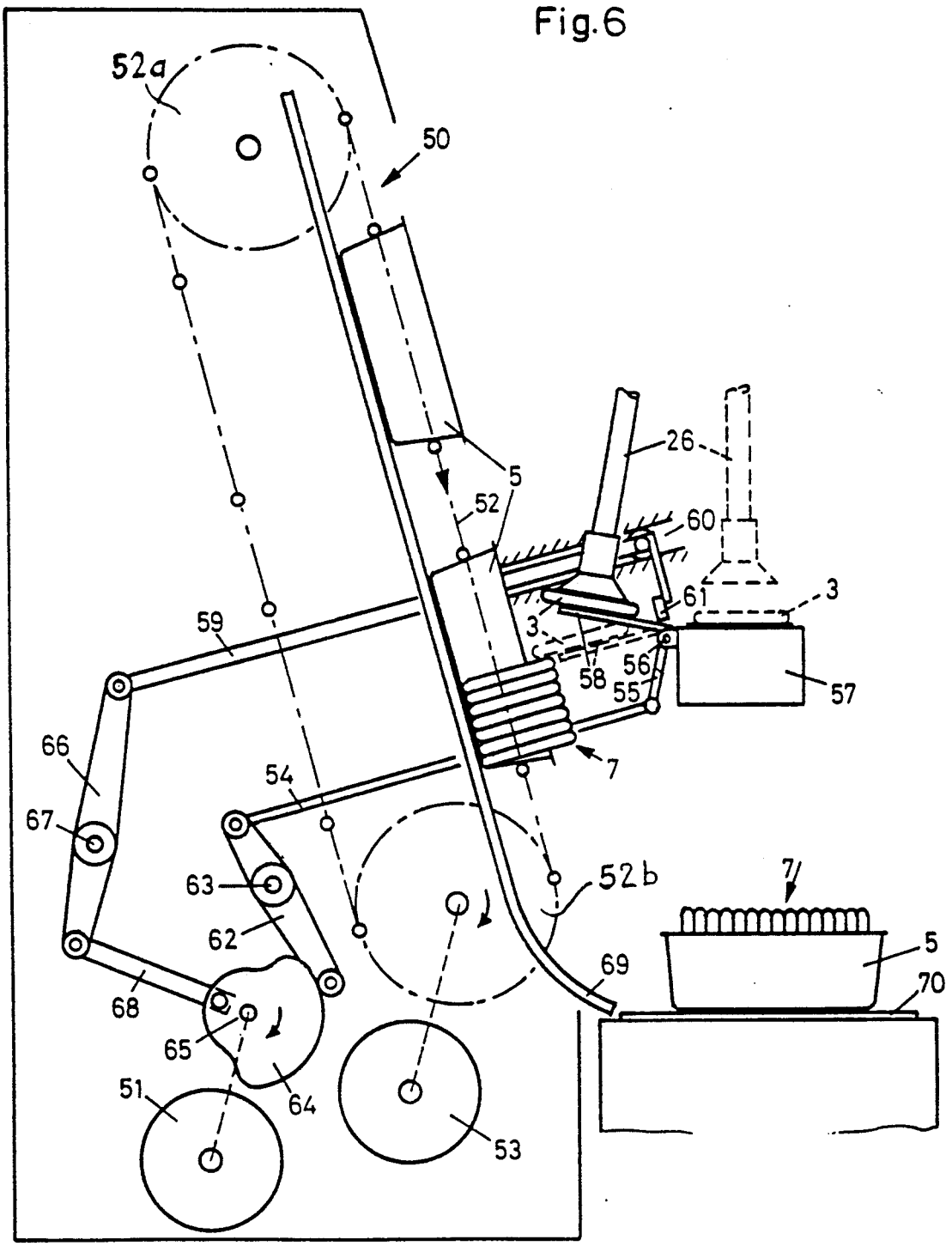
FIG. 6 is a schematic side elevational view of a lowering device forming part of the apparatus according to the invention.

Turning to FIG. 6, the lowering device generally designated at 50 includes an endless conveyor chain 52 which, by means of end sprockets 52*a* and 52*b* is oriented generally vertically, but preferably at a slight inclination to the vertical. The conveyor chain 52 carries containers 5 which may of plastic and which constitute side-by-side arranged group-forming chambers as shown in FIG. 2. The conveyor chain 52 is circulated by the motor 53. The conveyor chain 52 moves the containers 5 stepwise just before an article is deposited in the container 5 and the length of each step may be, for example, equal to the thickness of the article handled. For this purpose, an auxiliary mechanism with levers and rods is provided. A rod moves a lever 55 which is pivotal about a pin 56 of a carrier 57, thus forming a tilting mechanism. The lever 56 effects a tipping motion of a support tray 58 from an upwardly inclined position to a downwardly inclined position which facilitates the sliding of an item 3 situated on the tray 58 onto the uppermost article of an article group 7 being formed in the container 5. A further rod 59 moves in a guide 60 and carries a pusher 61 which imparts a pushing pulse to a respective article at appropriate moments. The rod 54 is moved by a further lever 62 which, by means of a cam disc 64, is rotated about a pin 63. The cam disc 64 is rotatably supported on a shaft 65. The rod 59 is moved by a further lever 66 which is rotatably supported on a shaft 67. The latter, in turn, is oscillated by a drive rod 68 eccentrically connected with the cam disc 64 which, in turn, is driven by the motor 51. In the lower region of the conveyor chain 52 a ramp 69 is provided for facilitating the deposition of the container 5 on a further conveyor belt 70.

In the description which follows, the operation of the above-described device will be set forth.

The articles 3 advanced on the conveyor belt 1 in irregular distances ar sensed by the optical barrier 19 and the signals representing their position on the conveyor belt 1 are stored in the control device 20 in conjunction with the signals emitted by the rotary angle indicator 21 from the moment the sensor 19 senses the presence of an article. The distance travelled by the sensed article from the sensor 19 to the last (downstream) gripper 26 is known and corresponds to a known turning angle of the shaft of the conveyor-driving motor 23. When thus the leading article 3 has reached the last (downstream) gripper 26, which is known by the control apparatus from the sensed rotary angle of the shaft of the motor 23, the control apparatus 20 actuates the motor 28 of that gripper 26 so that the latter is lowered onto the article therebelow and lifts the article off the conveyor belt 1 by means of the suction cup 32 to a height which corresponds to at least one article thickness. The two consecutive articles 3 are grasped by the two other grippers 26 in the same manner.

As soon as all three grippers 26 have grasped and lifted an article, the motor 31 lowers the three grippers 26 jointly into a position above the group which is situated in the region of the container 5. The vacuum supply to the grippers 26 is briefly interrupted so that the articles 3 are deposited on the tiltable support tray 58. Thereafter the tray 58 is tilted downwardly and the pusher 61 pushes the articles 3 onto the stack 7 which is being formed in the container 5. The grippers 26 are thereafter swung back by means of the motor 31 in order to grasp the subsequent articles 3 of the column 10 in a likewise manner.

After each or every other of the above-described steps the conveyor chain 52 is moved by the motor 53 through a distance which approximately corresponds to the thickness of one article 3.

After the container 5 is filled, the next empty container 5 is lowered through a distance which approximately corresponds to the distance between two containers. This lowering step to position an empty container 5 to begin receiving articles from the gripping device 25 may be performed more rapidly than the lowering steps executed while the stacks are being formed.

The above-described apparatus is capable of operating at very high speeds because the articles 3 need not be accumulated and need not be grasped during their conveyance in the conveying direction A. There is no alignment necessary so that the articles may be directly grasped in the apparatus as they are delivered, for example, from a baking oven or an upstream-arranged handling machine. Since no accumulating tracks are needed, the articles are handled in a very gentle manner so that the apparatus is capable of stacking even very delicate confectionery items. Due to the lack of aligning and accumulating tracks and because of the fact that several grippers 26 are moved simultaneously, the structural length is short as compared to conventional stacking devices. Further, a very high operational safety may be achieved by arranging downstream of the gripping devices 25 a similarly constructed standby (reserve) gripping device which may serve a plurality of columns 10. In case of a breakdown of one of the gripping devices 25, the standby gripping device may take over operation. Even individual, missed items may be grasped by the standby gripping device if, for example, on each gripper 26 there is mounted a vacuum sensor which reports the correct grasping of an item to the control apparatus 20.

The apparatus according to the invention has a modular construction and thus may be economically manufactured. It is feasible, for example, to provide an additional, after-connected gripping device 25 to effect a stack complementation after verifying the weight or length of the stack 7.

The method according to the invention thus makes possible the filling of containers (open at least on one side) with flat, disc or wafer-like products, such as confectionery items in an advantageous manner such that in the direction of conveyor advance at least two or three articles which are non-uniformly spaced from one another in the advancing direction may be grasped in the same operational cycle, yet at different moments in time by lifting the articles to a height which corresponds at least to the height of one item and moving the articles through a distance which corresponds at least to the width of one article and which is transverse to the direction of advance of the conveyor belt, over an intermediate surface (support tray). Thereafter the articles are lowered and then the articles which are present in a predetermined number on the intermediate surface, are placed by means of an advancing mechanism into the open containers. The containers, in turn, are lowered approximately to the extent of the thickness of one article before the subsequent articles are deposited into the containers by the advancing mechanism.

As shown in FIG. 6, the conveyor belt 1 is preferably horizontal and the conveyor chain 52 is situated laterally of the conveyor belt 1, in a generally vertical orientation with a slight inclination to the vertical. The conveyor chain 52 may be a dual chain. The conveyor chain and the container are preferably arranged obliquely to make possible a stacking of even those items which otherwise are difficult to stack.

Further, an additional auxiliary mechanism may be provided to open the upper edge of the container with a holder in a shoe horn fashion so that even the last item of a group may be securely stacked.

It will be understood that the above description of the present invention is susceptible to various modifications, changes and adaptations, and the same are intended to be comprehended within the meaning and range of equivalents of the appended claims.

What is claimed is:

1. In a method of forming article groups from flat articles, including the step of advancing, in a direction of advance, an article column formed of individual, flat-lying articles spaced from one another on a conveyor surface in said direction of advance, the improvement comprising the following cyclical steps:

(a) sensing the presence of articles by a sensor in predetermined locations and generating signals representing information on said presence;

(b) storing said signals;

(c) individually grasping, as a function of the stored signals, individual articles at locations downstream of said sensor as viewed in said direction of advance, by a plurality of grippers arranged in a series oriented parallel to said direction of advance;

(d) lifting the grasped articles by the grippers off the conveyor surface to a height corresponding at least to a maximum thickness of an article;

(e) moving the lifted articles by the grippers transversely to said direction of advance over a support tray situated laterally of said conveyor surface and releasing the articles by the grippers onto the support tray;

(f) simultaneously depositing the articles from the support tray into group-forming chambers for building an article stack therein; and (g) lowering the group-forming chambers to an extent approximately corresponding to the maximum article thickness.

2. The method as defined in claim 1, wherein the gripping step is performed on each article during advance thereof in said direction of advance.

3. The method as defined in claim 1, wherein step (c) includes the step of gripping the articles by different said grippers at different moments; and further wherein step (e) includes the step of simultaneously moving said grippers transversely to said direction of advance and simultaneously releasing the articles onto said support tray.

4. An apparatus for forming article groups from flat articles, comprising (a) a belt conveyor for advancing thereon an article column formed of individual, flat-lying articles spaced from one another on a conveyor surface of said belt conveyor in said direction of advance;

(b) a sensor supported above the conveyor surface for sensing the presence of articles at predetermined locations on said conveyor surface and generating signals representing information on said presence;

(c) a plurality of grippers situated downstream of said sensor as viewed in said direction of advance and spaced from one another parallel to said direction of advance; each gripper including grasping means for grasping an article on said conveyor surface;

(d) means for shifting said grippers from above said conveyor surface to a position laterally of said conveyor surface;

(e) a group-forming device including (1) a plurality of containers; and (2) a mechanism for positioning the containers at a location in which the articles are released by said grippers and are deposited into said containers to form stacks of superposed articles therein; said mechanism includes means for moving the containers stepwise downwardly from said location; and (f) a control apparatus having an input connected to said sensor for receiving said signals therefrom; said control apparatus further including outputs connected to said means for shifting said grippers and to said mechanism for operating said means for shifting said mechanism as a function of said signals.

5. The apparatus as defined in claim 4, further comprising means for individually lifting said grippers off said conveyor surface and said shifting means including means for jointly moving said grippers into said position.

6. The apparatus as defined in claim 4, wherein said sensor includes means for determining a position of the articles parallel to said direction of advance and transversely thereto and further wherein said shifting means includes means for moving said grippers relatively to one another transversely to said direction of advance into said position.

7. The apparatus as defined in claim 4, wherein said means for shifting includes (a) a pivot shaft supported above said conveyor surface in an orientation parallel to said direction of advance; said grippers being connected to said pivot shaft; and (b) a motor connected to said control apparatus and said pivot shaft.

8. The apparatus as defined in claim 4, wherein said belt conveyor comprises a conveyor belt including said conveyor surface, a motor driving said conveyor belt and having a shaft, and an angular position indicator connected to said shaft and said control apparatus for applying signals thereto representing angular positions of said shaft.

9. The apparatus as defined in claim 4, wherein said mechanism of said group-forming device is situated laterally of said conveyor surface and includes means for effecting a stepwise lowering of said containers.

10. The apparatus as defined in claim 4, said group-forming device further comprising (a) a support tray situated in said position for receiving articles released by said grippers;

(b) tilting means for periodically tilting said support tray towards said containers;

(c) a pusher member;

(d) moving means for periodically actuating said pusher member to push articles downwardly on said support tray; and (e) means for coordinating said tilting means and said moving means to actuate said pusher member after said tilting means has tilted said support tray.

* * * * *